US005298124A

United States Patent [19]

Eklund et al.

[11] Patent Number: 5,298,124

[45] Date of Patent: Mar. 29, 1994

[54] TRANSFER BELT IN A PRESS NIP CLOSED DRAW TRANSFER

[75] Inventors: Nils O. Eklund, East Greenwich, R.I.; Lars E. C. Fagerholm, Vanda, Finland; Lynne R. Muscato, Foxborough, Mass.

[73] Assignee: Albany International Corp., Albany, N.Y.

[21] Appl. No.: 897,074

[22] Filed: Jun. 11, 1992

[51] Int. Cl.[5] ..... D21F 3/00

[52] U.S. Cl. ..... 162/306; 162/358.2; 162/358.4; 162/360.2; 162/901; 428/252; 428/265

[58] Field of Search ..... 162/306, 358.4, 358.3, 162/358.2, 360.2, 360.3, 900, 901; 428/252, 265

[56] References Cited

U.S. PATENT DOCUMENTS

| | | | |
|---|---|---|---|
| 4,483,745 | 11/1984 | Wicks et al. | 162/205 |
| 4,500,588 | 2/1985 | Lundstrom | 162/900 |
| 4,529,643 | 7/1985 | Lundstrom | 162/900 |
| 4,552,620 | 11/1985 | Adams | 162/358.4 |
| 4,976,821 | 12/1990 | Laapotti | 162/360.2 |
| 5,002,638 | 3/1991 | Gulya et al. | 162/206 |
| 5,178,732 | 1/1993 | Steiner et al. | 162/360.2 |

FOREIGN PATENT DOCUMENTS 1188556 6/1985 Canada .

*Primary Examiner*—Karen M. Hastings

*Attorney, Agent, or Firm*—Kane, Dalsimer, Sullivan, Kurucz, Levy, Eisele and Richard

[57] ABSTRACT

A transfer belt for eliminating an open draw between a press in a papermachine and a transfer point has a supporting base with a particle-filled polymer coating. The coating, which constitutes the paper side of the transfer belt, carries the paper sheet from a press nip in a closed draw to a transfer point without sheet flutter or drop-off. At the transfer point, the paper sheet is readily released to another sheet-conveying papermachine-clothing product. The transfer belt may carry the sheet through more than one press nip. The transfer belt surface has a pressure-responsive recoverable degree of roughness, which is made relatively smooth by compression in the press nip, allowing the thin, almost continuous water film to form between the transfer belt and the paper sheet. When leaving the press nip, the paper sheet is held to the transfer belt by the thin, almost continuous water film. Following exit from the press nip, the transfer belt surface recovers its uncompressed roughness, breaking up the water film, so that, by the time the paper sheet reaches the transfer point, it is readily released by the transfer belt to the next sheet-conveying papermachine-clothing product, which might be a felt, a belt, or a fabric.

38 Claims, 7 Drawing Sheets

TRANSFER BELT IN A PRESS NIP CLOSED DRAW TRANSFER

BACKGROUND OF THE INVENTION

I. Field of the Invention

The present invention relates to the transfer of a paper sheet between sections, or between elements of a section, such as the individual presses in a press section, of the papermachine on which it is being manufactured. Specifically, the present invention is a transfer belt designed both to carry a paper sheet through a portion of a papermachine, so as to eliminate open draws, wherein the paper sheet receives no support from a carrier and is susceptible to breakage, from the machine, and to release the sheet readily to another fabric or belt at some desired point.

II. Description of the Prior Art

The prior art is replete with proposals for eliminating so-called open draws from papermachines. By definition, an open draw is one in which a paper sheet passes without support from one component of a papermachine to another over a distance which is greater than the length of the cellulose fibers in the sheet. All such proposals for eliminating open draws have as their object the removal of a major cause of unscheduled machine shut-down, the breakage of the sheet at such a point where it is temporarily unsupported by a felt or other sheet carrier. When disturbances in the normally stable flow of paper stock occur, the likelihood of such breakage is quite strong where the unsupported sheet is being transferred from one point to another within the press section, or from the final press in the press section to the dryer section. At such points, the sheet usually is at least 50% water, and, as a consequence is weak and readily broken. At present, then, an open draw will place a limitation on the maximum speed at which the papermachine may be run.

The prior-art proposals for eliminating open draws include some form of transfer belt to carry and support the paper sheet between components of the papermachine. In so doing, the transfer belt may have to carry out several of the following separate functions:

a) to take the paper sheet from a press roll or press fabric (felt);
b) to carry the paper sheet into a press nip;
c) to work cooperatively with a press fabric in the press nip to de-water the paper sheet;
d) to carry the paper sheet out of the press nip;
e) to repeat functions b) through d) as necessary where the transfer belt carries the paper sheet through more than one press; and
f) to transfer the paper sheet to another fabric or belt, such as, for example, a dryer fabric.

As will be discussed below, there are specific problems associated with each of these transfer belt functions.

Transfer belts are shown in a number of issued U.S. patents. For example, U.S. Pat. No. 4,483,745 shows press arrangements which may be either the typical paired roller press or a long-nip press. In the press arrangements illustrated, the paper sheet is sandwiched between a press fabric and a looped, endless, and impermeable belt which is relatively smooth and hard, so that the paper sheet may follow the belt upon leaving the press nip without being rewet by a press fabric or other permeable belt. This arrangement utilizes the fact known to papermakers that the paper sheet will follow the surface to which it may be most strongly bonded by a thin, continuous water film, and for this reason will follow a smooth, impervious surface rather than a coarser surface when the two are separated in a papermachine.

Little detail is provided, however, on the structure of the belt itself beyond describing it as having a smooth upper surface with a smoothness and a hardness or density generally similar to a plain press roll cover. The belt surface is said to preferably have a hardness in the range of between 10 and 200 P&J (Pusey & Jones Hardness Scale). No recognition is given to the difficulty which would actually be encountered in attempting to remove a wet paper sheet from the surface of such a belt in a papermachine.

U.S. Pat. No. 4,976,821 shows another press configuration with no open draws. In the press sections described and illustrated therein, there are two successive press nips for dewatering a paper sheet, which passes in a closed draw between the nips. The paper sheet is also transferred from the last press nip of the press section to the drying section in a closed draw by a substantially non-water receiving transfer fabric. The paper sheet is removed directly from the surface of the substantially non-water receiving transfer fabric, and placed onto a dryer fabric by means of a suction roll.

In contrast to the belt shown in the '745 patent, the substantially non-water receiving transfer fabric shown in the '821 patent generally is relatively impervious, and may, for example, be a fabric produced by impregnating a press fabric with an appropriate plastic material. That is to say, it is relatively impervious when compared to an unimpregnated press fabric. As such, however, the '821 patent teaches that the fabric may still to some extent participate in the dewatering of the paper sheet in the press nip, so that the paper produced may be more symmetric in density and surface smoothness than that produced when the transfer belt is smooth and impermeable. While it is said to be easier to remove the paper sheet from the surface of such a transfer fabric, there is no recognition given to the problems actually associated with the use of a transfer fabric of this variety on a papermachine. In actual use, such a sheet transfer belt, designed to function with a low, constant porosity, will eventually meet with failure. Fine particles from the paper stock, such as cellulose fines, fillers, resins, and "stickies", rapidly fill the pores in such a belt. High-pressure water jet showering, the standard method to keep fabrics and felts clean and open on a papermachine, is not efficient on a fine-porous structure such as the one described in this '821 patent.

In general, and referring to the various functions of a transfer belt identified above, where the transfer belt removes the paper sheet from a press roll, a procedure rarely used in practice, it must overcome the strong adhesion the paper sheet will normally have for the roll, which may be very smooth. In the in-going side of a press nip, the paper is squeezed until it becomes fully saturated, at which point water will start to move out from the sheet into the water receptor, the press fabric. As a consequence, there will always be a water film, perhaps partly broken, at the interface between the roll surface and the paper sheet. This film has to be broken before the paper sheet may be reliably transferred from the roll to the transfer belt.

Where the transfer belt carries the paper sheet into a press nip, a belt having a non-air-permeable paper-side surface is generally preferred to one which is permeable. A transfer belt which may be permeable to some extent is described in the '821 patent discussed above. Others are described in U.S. Pat. Nos. 4,500,588 and 4,529,643, which will be discussed below. The disadvantage associated with the use of permeable or semi-permeable transfer belts is the risk of blowing of the paper sheet at the entrance of the press nip, as a result of air being forced out of the porous belt being compressed, or even through the transfer belt from its backside by a press roll.

In the press nip, the transfer belt must work cooperatively with a press fabric to dewater and to densify the paper sheet. As a consequence, the surface topography and compression properties of the transfer belt are critical for producing a paper sheet with a smooth, mark-free surface. Because, as is well known to those skilled in the art, even a high quality, well-broken-in press fabric may provide a very non-uniform pressure distribution in the nip, a transfer belt having a smoother and harder paper-side surface than the press fabric will provide a more uniform pressure distribution to the paper sheet being dewatered, and will impart a smoother surface to the sheet.

Further, a transfer belt with suitable compression properties can in effect lengthen the press nip to increase the time the paper sheet is exposed to pressure and to allow more time for water to leave the paper sheet under a given press load. In addition, a transfer belt with a paper side impermeable to water and air will contribute to the dryness of the paper sheet by eliminating the possibility of rewet after the press nip, as may occur when a conventional press fabric carries the paper sheet out of the nip.

Clearly, a transfer belt must be designed with the understanding that it will work cooperatively in the nip with a press fabric as a functional pair in order to provide high dewatering efficiency and high paper quality.

Referring again to the various transfer belt functions identified above, the transfer belt should carry the paper sheet out of the press nip. That is to say, more precisely, the paper sheet should adhere to the surface of the transfer belt upon exiting the nip, as opposed to following the press fabric out of the nip and then moving over to the transfer belt after the nip. Not only does the latter permit rewet while the paper sheet remains in contact with the press fabric, but the moving of the paper sheet over to the transfer belt after leaving the press nip would also constitute an open draw, the very problem the transfer belt is intended to eliminate. Such a situation can lead to blistering or some other deformation of the paper sheet. A good adhesion of the sheet to the transfer belt on the exit side of the nip is even more important in press configurations where the belt is run in the top position and the sheet is to be transferred on the underside of the belt. As before, the paper-side surface of the transfer belt should be neither water-absorbent nor waterpermeable, so that rewet of the paper sheet by the transfer belt may be avoided.

Where the transfer belt carries the paper sheet through more than one press, the stability of the transfer belt will become an important factor. The speed of consecutive presses in a press section can never be absolutely synchronized, and, normally, will increase somewhat downstream in the section. Under such conditions, the transfer belt must be able to carry the paper sheet without blowing, blistering, or drop off. In addition, the transfer belt itself must be of a durable design, capable of enduring the backside wear and high shear forces, which would attend its use through more than one press, without rapid degradation.

The final, and most critical, function of the transfer belt is to effect a correct transfer of the paper sheet to the next section of the papermachine. In many applications, this will be a transfer to the first fabric in the dryer section. It is preferred that this first fabric should be of a design suitable for both paper drying and for the closed transfer of the paper sheet.

A typical dryer fabric in the first drying position may be a woven, all-polyester monofilament fabric. Fabrics used in first drying positions normally have a low air-permeability and a smooth, fine paper side. Hence, the surface to which the transfer belt is to transfer the paper sheet may initially consist of smooth, hydrophobic monofilament knuckles.

The transfer from the transfer belt to the first dryer fabric should be carried out with as low a contact pressure as possible in order to avoid the marking of the paper sheet by the knuckles. Since the dryer fabric is air-permeable, vacuum may be used to assist the transfer of the paper sheet from the transfer belt. In order to avoid the marking of the paper sheet by the knuckles of the first dryer fabric, the vacuum level used at the transfer point must be as low as possible. It follows, then, that the transfer belt must readily release the paper sheet at the transfer point so that the vacuum level required may be kept at a minimum level.

As noted above, transfer belts of several varieties are known in the prior art. For example, in U.S. Pat. No. 5,002,638 a wet paper web is supported on a press fabric and passed through the nip between cooperating press rolls to extract water from the web. The press fabric, supporting the paper web, then travels through a span of distance and is passed around a heated dryer roll in the dryer section with the felt being interposed between the heated roll and the paper web. The press fabric is thus heated and insulates the paper web from the high temperature roll. The paper web is then separated from the press fabric and travels around the remaining dryer rolls in the dryer section, while the heated press fabric is returned to the nip into position to support the wet paper web.

The disadvantage following such an approach is considerable rewet of the paper sheet in the span between the press nip and the heated dryer roll, because the transfer belt is literally a press fabric. Further, such a transfer belt is not hard enough to replace a smooth roll surface in late presses on a publishing-grade papermachine. In short, the only reasonable application for a transfer belt of the variety shown in U.S. Pat. No. 5,002,638 is in slow machines producing heavy paper grades.

The use of modified press fabrics as transfer belts is shown in several U.S. patents. For example, U.S. Pat. No. 4,500,588 shows a conveyor felt for conveying a paper web through a press section of a paper machine. The conveyor felt is, with the exception of the surface portion of the fiber batt layer facing the web, filled with a filling material so that the felt is completely air-impermeable and has a chamois-like surface. Such a surface is, because of its fibrous character, sensitive to soiling by sticky materials, and the chamois-like structure is sensitive to wear and difficult to maintain.

In U.S. Pat. No. 4,529,643, a press felt for conveying a paper web through a press section of a papermachine is shown. It comprises a support fabric formed of a yarn structure and a fibre batt layer, formed of fibers and needled to at least one side of the support fabric. The support fabric and the fiber batt layer are filled with a filling material, preferably from the surface facing the paper with a rubber or resin emulsion, so that the press felt remains slightly air permeable.

Belts of the variety shown in these two patents have exhibited sheet drop-off upon exit from the press nip. The cause of this sheet drop-off is related to the inability of the porous surface of such a belt to permit a thin, continuous water film to form between its surface and a paper sheet in the press nip, and to maintain such a water film long enough to ensure that the paper sheet will follow the belt rather than the press fabric upon exit from the press nip. In addition, it is difficult to maintain the porosity of this variety of belt at a constant value, as material from the paper stock gradually fills the pores. High-pressure showers have not proved effective on the microporous structure of the surface of such belts, and may actually destroy the belt surface.

Finally, non-compressible, coated belts, such as those used as long nip press (LNP) belts, have also been tested for use as transfer belts. A belt of this kind is shown in Canadian Patent No. 1,188,556, and comprises a base fabric which is impregnated with a thermoplastic or thermosetting polymeric material. The belt is of uniform thickness, and has at least one smooth surface. While the belt performs in a superior manner in its intended position on a long nip press, all attempts to use it as a transfer belt have failed, as the belt could not be arranged to release a paper sheet to a dryer fabric. This is believed to result from the failure of a thin film of water between the impermeable belt and the paper sheet to break up into droplets, allowing the paper sheet to be separated from the transfer belt.

The present invention provides a long-sought solution to these difficulties in the form of a transfer belt not susceptible to the shortcomings of the prior-art transfer belts discussed above.

SUMMARY OF THE INVENTION

In view of the preceding discussion, it may be understood that a successful transfer belt must be able to carry out several different functions as it carries a paper sheet from place to place in a papermachine. Correspondingly, the behavior of the transfer belt must change in response to the conditions under which it is placed at different locations in the machine.

The most critical of these functions are: a) to remove the paper sheet from a press fabric without causing sheet instability problems; b) to cooperate with a press fabric in one or more press nips to ensure optimal dewatering and high quality of the paper sheet; and c) to transfer the paper sheet in a closed draw from one press in the press section to a sheet-receiving fabric or belt in the next press, or presses, in the press section, or to a dryer pick-up fabric in the dryer section.

The surface of the transfer belt must have a topography on a microscopic scale with a degree of roughness which decreases, or smooths out, under the levels of compression to which the belt is typically subjected in a press nip, but which restores itself after exit from a press nip, to carry out these functions. In other words, the surface topography of the transfer belt must have a pressure-responsive, recoverable degree of roughness, so that, when under compression in a press nip, the degree of roughness will decrease, thereby enabling a thin continuous water film to be formed between the transfer belt and a paper sheet to bond the paper sheet to the transfer belt upon exit from the press nip, and so that, when the original degree of roughness is recovered after exit from the nip, the paper sheet may be released by the transfer belt, perhaps with the assistance of a minimum amount of vacuum, to a permeable fabric, such as a dryer pick-up fabric. At the same time, the transfer belt must have the necessary compression and hardness properties to produce a mark-free paper.

In addition to having a surface topography with a pressure-responsive, recoverable degree of roughness, a successful transfer belt must also have an optimal combination of the following additional functional properties: 1) surface energy, which will determine the interaction of the surface of the transfer belt with water; 2) limited permeability to air or water; 3) compressional properties, both for the surface of the belt and for its structure as a whole; 4) hardness; 5) modulus; 6) durability; and 7) chemical, thermal and abrasion resistance.

The present invention is a transfer belt for a papermaking, boardmaking or similar machine having a surface topography with the requisite pressure-responsive recoverable degree of roughness, and having an optimal combination of the above-noted additional functional properties. This transfer belt has been successfully tested on a papermachine under several machine configurations and manufacturing a number of different paper grades, and has been found to carry out the critical functions identified above where prior-art attempts have failed. The pressure-responsive, recoverable degree of roughness remains a characteristic of the transfer belt throughout its entire lifetime on the papermaking or boardmaking machine so that the transfer belt will be capable of carrying out its intended function for that time.

The transfer belt of the present invention comprises a reinforcing base with a paper side and a back side, and having a polymer coating, which includes a balanced distribution having segments of at least one polymer, on the paper side. This balanced distribution takes the form of a polymeric matrix which may include both hydrophobic and hydrophilic polymer segments. The polymer coating may also include a particulate filler. The reinforcing base is designed to inhibit longitudinal and transverse deformation of the transfer belt, and may be a woven fabric, and may be endless or seamable for closing into endless form during installation on the papermachine. Further, the reinforcing base may contain textile material, and may have one or more fiber batt layers attached by needling onto its back side. By textile material is meant fibers and filaments of natural or synthetic origin, intended for the manufacturing of textiles. The back side may also be impregnated and/or coated with polymeric material.

In this regard, the back side of the transfer belt should be of a structure suitable for running against the rolls in the press section of a papermachine, and must be of a material at least as durable as that on the paper side of the belt. Textile structures, that is, fibers or filaments of natural or synthetic polymers, which have been woven, knitted, braided, entangled or bonded into a sheet-like structure, in other words, textiles, may be attached to the back side. Alternatively, a solid film, formed by coating the back side of the reinforcing base with the same polymer as is used on the paper side, may be attached to the back side of the transfer belt. This film may be made porous by including within the coating to be used on the back side of the reinforcing base a watersoluble resin, which may be dissolved after the curing of the polymer to create pores. Finally, a polymeric foam may be attached to the back side of the reinforcing base to form the back side of the transfer belt.

The transfer belt may be characterized as having a sheet-facing surface with a well-defined topography and a well-defined surface energy, such a surface being favorable for taking a paper sheet from a press roll or press fabric, and carrying it into a press nip, where it cooperates with a press fabric. The surface itself includes regions defined by the hydrophilic and hydrophobic polymer segments (or particle segments) of the polymer matrix in the coating. In the present context, surface energy may be taken to be a measure of the wettability of the surface of the transfer belt by water. The hydrophilic polymer segments of the polymer matrix have a higher surface energy than the hydrophobic polymer segments, and, by comparison, are more wettable by water. Upon exit from a press nip, the two polymer segments of the polymer matrix are believed to cooperate in playing at least a part in breaking up the water film, as water will tend to form beads on those surface regions defined by the hydrophilic polymer segments of the polymer matrix.

The transfer belt may be further characterized as having a sheet-facing surface, optimally impermeable to water and air, with a pressure-responsive microscale topography. Under pressure, the microscale degree of roughness of this surface decreases, making the surface much smoother and allowing a thin, continuous film of water to be built up between the paper sheet and that surface. Such a thin, continuous film of water provides much stronger adhesive forces between the paper sheet and transfer belt than those between the paper sheet and the press fabric, so that the paper sheet may consistently and reliably follow the transfer belt when leaving the press nip. Even where the press fabric, by reason of structural expansion, creates a light vacuum at the outgoing side of the press nip, the energy required to overcome the adhesive forces arising from the water film between the transfer belt and paper sheet is greater than that required to overcome any adhesion the paper sheet may have for the press fabric. In addition, the caliper regain of the paper sheet upon exit from a press nip is normally much slower than that of the press fabric. As a consequence, when a light vacuum arises in both the expanding press fabric and expanding paper sheet upon exit from the press nip, the latter holds its vacuum for a longer period of time and sticks to the transfer belt by virtue of the thin, continuous water film disposed therebetween. As a consequence, the paper sheet will follow the transfer belt.

Despite the strong adhesion the paper sheet has for the surface of the transfer belt at the nip exit, the material composition of the paper side of the belt and its surface characteristics provide it with the necessary release properties to successfully transfer the paper sheet to another fabric or belt. These release properties are a direct consequence of the use of an appropriate polymer coating, which may contain filler particles of a material having a different hardness than the polymeric matrix has itself, on the paper side of the transfer belt. This coating, having a surface topography with a pressure-responsive recoverable degree of roughness, ensures that the water film between the paper sheet and the transfer belt surface in the press nip will break up in the span between the press nip and the point where the paper sheet is to be transferred to another carrier, allowing the paper sheet to be released.

Although the polymer coating has been described above as being impermeable to air or water, complete impermeability is an optimal condition which will provide the transfer belt with the best function over a long period of time. A substantially impermeable belt, having a very low permeability to air and water, and having the polymer coating in accordance with the present invention, will also carry out the sheet-handling and transfer functions of the impermeable belts of the present invention. More specifically, the belt will be able to carry out these functions quite well so long as it has an air permeability of less than 20 cubic feet per square foot per minute, when measured according to the procedure set forth in "Standard Test Method for Air Permeability of Textile Fabrics", ASTM D 737-75, American Society of Testing and Materials, reapproved 1980. Such a low permeability will not adversely affect the transfer function of the present belt, and, in the course of use on a papermachine, will tend to decrease as pores in the belt become filled with paper fines and other materials.

The mechanism by which the water film is broken up during the span between the press nip and the point where the paper sheet is to be transferred to another carrier is thought to be primarily a function of the pressure-responsive microscale surface topography of the coating on the paper side of the transfer belt. In this regard, in order to break up the water film, the recovered degree of roughness of the surface topography of the transfer belt should be at least equal to the minimum caliper of the water film. Other mechanisms may be contributing to the ability of the present transfer belt to release the paper sheet at the desired time. For example, it has been proposed, as noted above, that the balanced distribution of polymer segments on the paper side of the transfer belt, each polymer segment having a different surface energy and wettability, assists the water film in breaking up into droplets, radically reducing the adhesion of the sheet to the transfer belt.

The presence of one or more particulate fillers in the polymeric coating material, which fillers themselves have different surface energies and wettabilities from the polymers, may also contribute to the breaking up of the water film, when a particulate filler is included in the coating. While individual particles in the filler have sizes falling within a range or distribution of values, larger particles, embedded in the belt surface, are thought to move out to protrude therefrom when the pressure is released upon exit from the press nip. In so doing, those larger particles would physically be able to cut through the water film. Since they too will have a different surface energies and degrees of hydrophilicity from the polymer segments of the polymer matrix of the coating, they may also cause the water to form beads thereabout. In addition, it is thought that the particulate fillers may reinforce the surface of the polymeric coating, so that its pressure-responsive, recoverable degree of roughness may not be polished away after an unduly short period of use on a papermachine.

It has also been proposed that the balanced distribution of polymer segments and one or more particulate fillers enable the surface of the transfer belt to release the paper sheet at the desired time, because the materials in the coating have different compressibilities. The slight pressure and shear placed on the belt surface in the transfer zone may cause the water film to break into droplets, thereby further reducing the adhesion of the paper sheet to the transfer belt.

As has been discussed above, the primary mechanism by which the present transfer belt releases the paper sheet at a desired point is thought to be its pressure-responsive, recoverable microscale surface topography, since the strength of the adhesive bond formed between the surfaces of the transfer belt and the paper sheet depends upon the actual interfacial contact area and surface roughness of each.

The water film between the paper sheet and transfer belt will tend to fill the low spots in the belt surface and to orientate to those regions defined by the hydrophilic polymer segments in the polymeric matrix surfaces. As the pressure distribution changes in the interface between sheet and belt during expansion after exit from the nip, the belt roughness will increase, after having been compressed to a smoother-than-normal condition in the nip. The increased roughness causes the water film to break. The work necessary to counteract the adhesion of the paper sheet to the transfer belt and to separate the two from one another depends upon surface tension, which decreases with increasing water film thickness. Where there are low spots in the surface of the transfer belt, the thickness of the water film will be increased. This reduces the adhesion of the paper sheet to the transfer belt at such locations and promotes sheet release.

It is also possible that air may be trapped in low spots on the surface of the transfer belt as the transfer belt, paper sheet and press fabric are entering the nip. As the paper sheet is compressed in the nip, the air is compressed into such low spots. In the outgoing part of the nip, this compressed air expands, exerting a pressure which helps to break the water film.

The particle filler in the coating, when included, may also contribute to the breaking up of the water film by physically acting as crack-initiating sites. This is particularly thought to be so for larger than average particles in the filler. Because the polymeric material will be resilient, particles of the filler residing on the surface of the coating will be depressed deeper thereinto by compression in the nip. Upon exiting the nip, the particles will protrude from the surface of the coating, where they begin to physically break the water film to start a de-bonding process in the interface.

It is most likely that the water film holding the paper sheet to the transfer belt is broken up in the span between the press nip and the transfer point by a combination of these mechanisms.

The polymer coating of the paper side of the transfer belt of the present invention is substantially, if not completely, impermeable to air or water, and has a surface smoothness within a certain range, different surface energies for each of its components, a hardness within a certain range and specified compression properties.

In summary, the transfer belt of the present invention is built on a supporting carrier for dimensional stability. The paper side layer may be made by coating, impregnation, film lamination, melting, sintering or deposition of a resin which through a secondary process forms a layer at least substantially impermeable to air and to water. The bottom layer, or back side, of the transfer belt can be textile, solid or porous film, or polymeric foam, or a combination of these. The paper side of the transfer belt is coated. The coating may be a homopolymer, a copolymer, a polymer blend or an interpenetrating network of polymers, and may contain a particulate filler.

A specific embodiment of the present invention will now be described in more complete detail, with reference frequently being made to the figures identified as set forth below.

DETAILED DESCRIPTION OF THE PREFERRED EMBODIMENT

Figure 1:
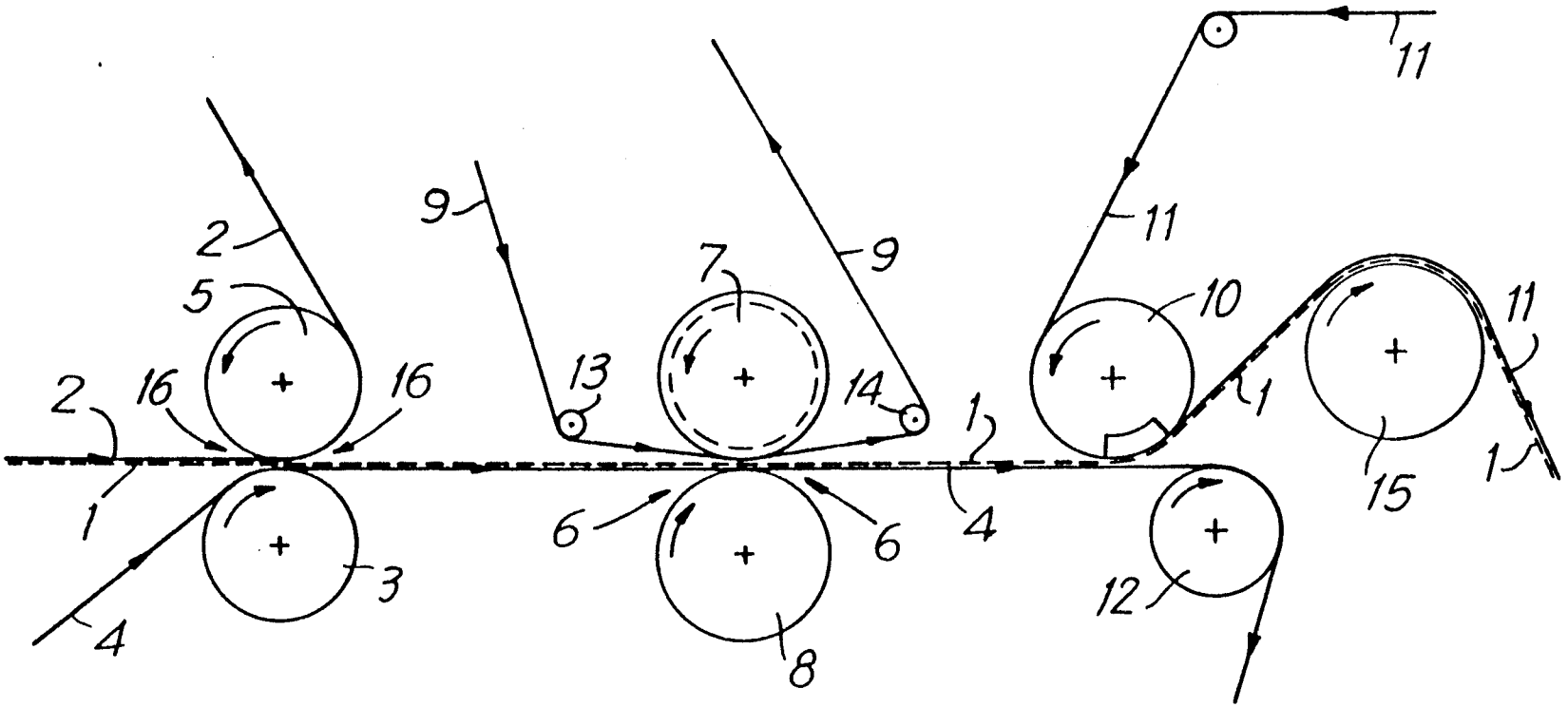
FIG. 1 shows a first representative press arrangement including a transfer belt for eliminating an open draw in a papermachine.
Figure 2:
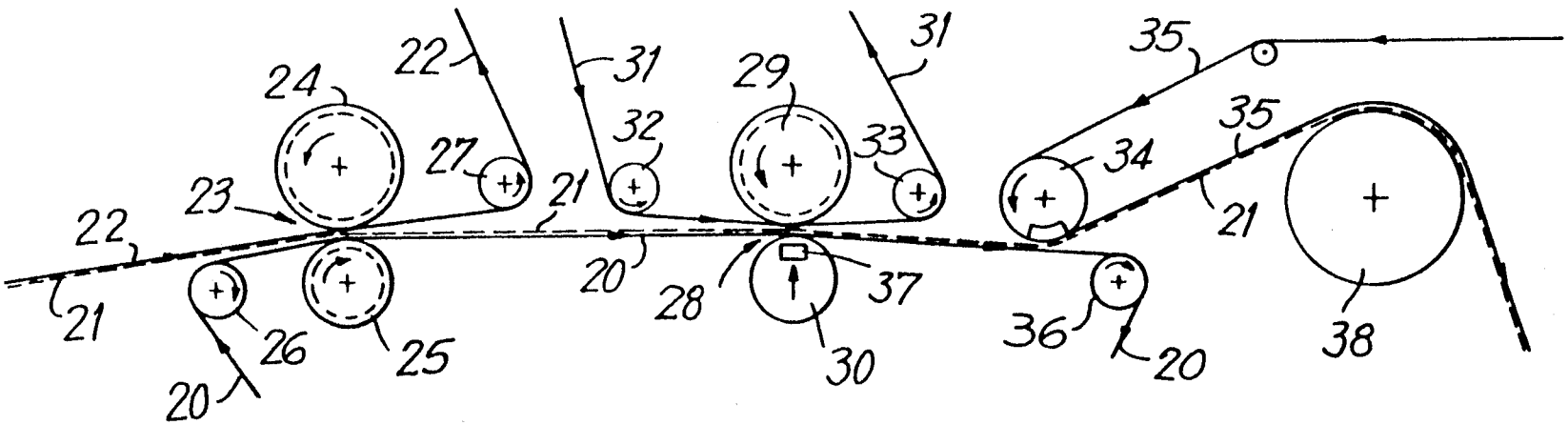
FIG. 2 shows a second such press arrangement.
Figure 3:
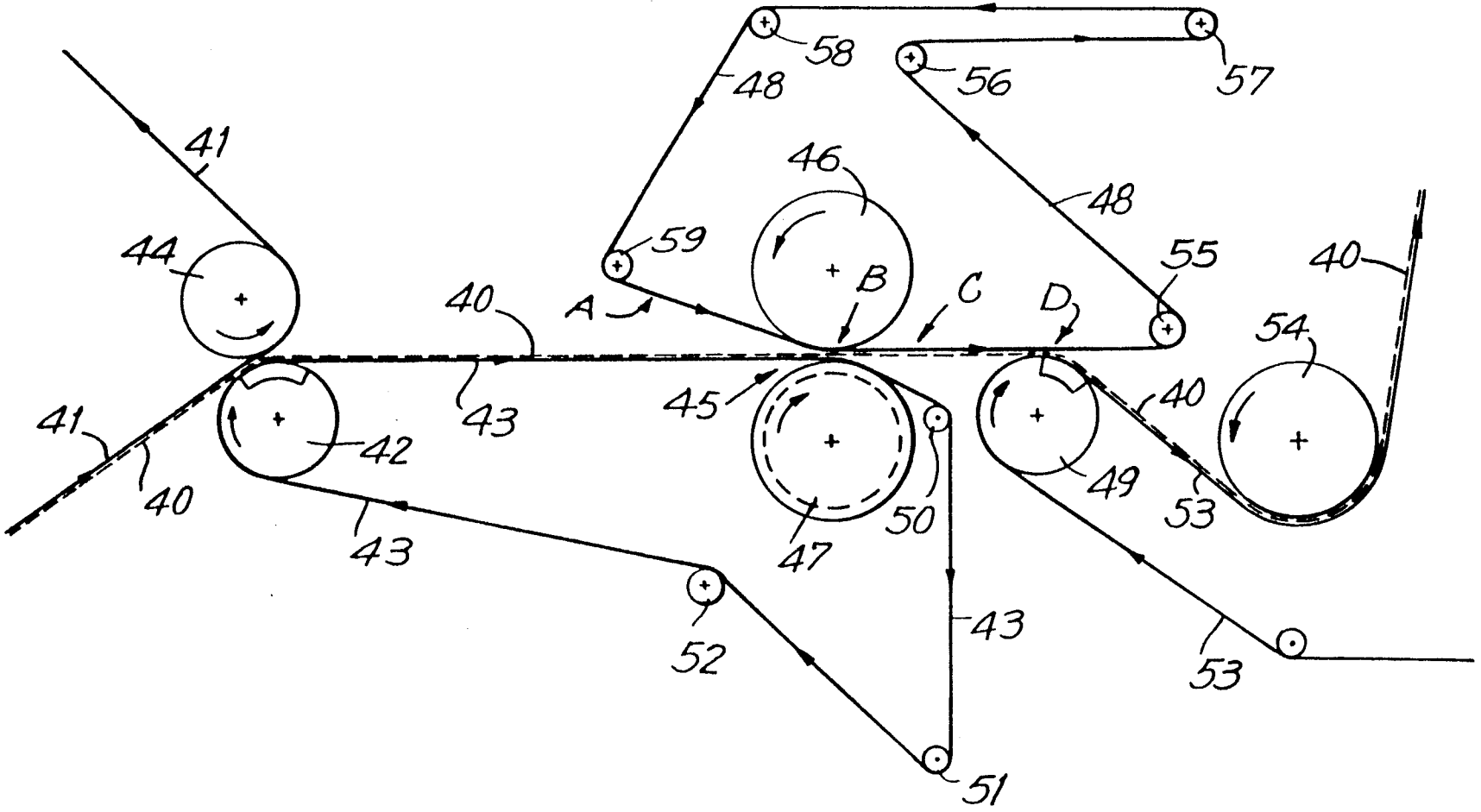
FIG. 3 shows a third such press arrangement.

Representative press arrangements which include a transfer belt for eliminating an open draw in a papermachine are shown, for purposes of illustration and general background, in FIGS. 1, 2 and 3. Arrows in these figures indicate the directions of motion or rotation of the elements shown therein.

Turning first to FIG. 1, a paper sheet 1, represented by a dashed line, is being carried toward the right in the figure initially on the underside of a pick-up fabric 2, which pick-up fabric has previously taken the paper sheet 1 from a forming fabric, not shown.

The paper sheet 1 and pick-up fabric 2 proceed toward a first press nip 16 formed by a first press roll 3 and a second press roll 5. A transfer belt 4 is trained and directed around first press roll 3. In the first press nip 16, paper sheet 1, carried on the underside of pick-up fabric 2, comes into contact with the surface of transfer belt 4.

Paper sheet 1, pick-up fabric 2, and transfer belt 4 are pressed together in first press nip 16. To transfer paper sheet 1 from pick-up fabric 2 to the transfer belt 4, a certain level of pressure, such as that provided in first press nip 16, is needed to cause a water film to be formed between paper sheet 1 and transfer belt 4. Most of the water in that water film comes from the paper sheet 1, which must be pressed in first press nip 16 with a pressure sufficient to cause the boundary layer between the surfaces of transfer belt 4 and paper sheet 1 to become filled with water. This water film causes paper sheet 1 to adhere to the surface of transfer belt 4, which is smoother and harder than pick-up fabric 2. Pick-up fabric 2, trained around second press roll 5, is separated from paper sheet 1 and transfer belt 4 upon exit from first press nip 16, while transfer belt 4 carries paper sheet 1 further toward a second press nip 6 formed between a third press roll 7 and a fourth press roll 8. A press fabric 9 is trained around third press roll 7, guided by a first guide roll 13 and a second guide roll 14, and dewaters paper sheet 1 in the second press nip 6. Third press roll 7 may be grooved, as suggested by the dashed line within the circle it in FIG. 1, to provide a receptacle for water removed from the paper sheet 1 in the second press nip 6.

Upon leaving the second press nip 6, paper sheet 1 remains adhered to the surface of the transfer belt 4, whose surface is smoother than that of press fabric 9. Proceeding to the right in FIG. 1 from second press nip 6, paper sheet 1 and transfer belt 4 next reach a vacuum transfer roll 10, about which is trained a dryer fabric 11. Suction from within vacuum transfer roll 10 lifts paper sheet 1 from the transfer belt 4 to the dryer fabric 11, which carries paper sheet 1 to the first dryer cylinder 15 of the dryer section.

The transfer belt 4 proceeds onward to the right in FIG. 1 away from vacuum transfer roll 10 to a third guide roll 12, around which it is directed to further guide rolls, not shown, which return the transfer belt 4 to first press roll 3, where it may again accept paper sheet 1 from pick-up fabric As may be observed in FIG. 1, the transfer belt 1 eliminates open draws in the press arrangement shown, most particularly the open draw between the second press nip 6 and the vacuum transfer roll 10. Most importantly, paper sheet 1 is supported at all points in its passage through the press arrangement shown by a carrier.

A somewhat more complicated press arrangement is shown in FIG. 2. There, a transfer belt 20 carries a paper sheet 21, again represented by a dashed line, through two presses, and on to a point where it is transferred to a dryer section.

More specifically, paper sheet 21 is initially being carried toward the right in the FIG. 2 on the underside of a pick-up fabric 22, which pick-up fabric 22 has previously taken paper sheet 21 from a forming fabric, not shown.

Paper sheet 21 and pick-up fabric 22 proceed together toward a first press nip 23, formed between a first press roll 24 and a second press roll 25. Transfer belt 20, trained about first guide roll 26, also proceeds toward first press nip 23, where it will receive paper sheet 21 from the underside of pick-up fabric 22, and carry paper sheet 21 onto another press. First press roll 24 and second press roll 25 may both be grooved, as suggested by the dashed lines within the circles representing these rolls in FIG. 2, to provide a receptacle for water removed in the first press nip 23 from the paper sheet 21. Second press roll 25 may be grooved for this purpose, since transfer belt 20 may be of the variety not completely impermeable to water, and therefore may participate to some extent in the dewatering of paper sheet 21.

Upon exiting from first press nip 23, paper sheet 21 adheres to the surface of transfer belt 20, as previously noted. Pick-up fabric 22 proceeds from first press nip 23, around second guide roll 27, and around further guide rolls, not shown, which together return it to the point where it accepts paper sheet 21 from a forming fabric.

Paper sheet 21 and transfer belt 20 proceed onward, to the right in FIG. 2, toward a second press nip 28, which may be and is depicted as a long press nip formed between a third press roll 29, which, too, may be grooved to provide a receptacle for water removed in the second press nip 28 from the paper sheet 21, and a long nip press arrangement 30 having a shoe 37. A press fabric 31, trained about third guide roll 32, also proceeds toward second press nip 28 to participate in the further dewatering of paper sheet 21.

Upon exiting from second press nip 28, paper sheet 21 remains adhered to the surface of transfer belt 20. Press fabric 31 proceeds from second press nip 28, around fourth guide roll 33, and around further guide rolls, not shown, which together return it to third guide roll 32, from which it will again proceed to second press nip 28.

Paper sheet 21 and transfer belt 20, proceeding to the right in FIG. 2 from second press nip 28, next reach a vacuum transfer roll 34, about which is trained a dryer fabric 35. Suction from within vacuum transfer roll 34 lifts paper sheet 21 from transfer belt 20 to the dryer fabric 35, which carries paper sheet 21 to the first dryer cylinder 38 of the dryer section.

The transfer belt 20 proceeds onward away from vacuum transfer roll 34 to a fifth guide roll 36, around which it is directed to further guide rolls, not shown, which return the transfer belt 20 to first guide roll 26, where it will again proceed on to first press nip 23.

As may again be observed in FIG. 2, the transfer belt 20 eliminates open draws in the press arrangement shown, and actually carries the paper sheet 21 through two presses to the point where it transfers the paper sheet 21 directly to dryer fabric 35. Paper sheet 21 is supported at all points in its passage though the press arrangement by a carrier.

Still another press arrangement is shown in FIG. 3. There, a paper sheet 40, again represented by a dashed line, is being carried toward the right initially on the underside of a pick-up fabric 41, which pick-up fabric 41 has previously taken the paper sheet 40 from a forming fabric, not shown.

The paper sheet 40 and pick-up fabric 41 proceed toward a first vacuum transfer roll 42, around which is trained and directed a press fabric 43. There, suction from within first suction roll 42 removes paper sheet 40 from pick-up fabric 41 and draws it onto press fabric 43. Pick-up fabric 41 then proceeds from this transfer point, toward and around a first guide roll 44, and back, by means of additional guide rolls not shown, to the point where it may again receive the paper sheet 40 from a forming fabric.

Paper sheet 40 then proceeds, carried by press fabric 43, toward a press nip 45 formed between a first press roll 46 and a second press roll 47. Second press roll 47 may be grooved, as suggested by the dashed line within the circle representing it in FIG. 3, to provide a receptacle for water removed in the press nip 45 from the paper sheet 40. A transfer belt 48 is trained around first press roll 46, and is directed through press nip 45 with paper sheet 40 and press fabric 43. In the press nip 45, the paper sheet 40 is compressed between the press fabric 43 and the transfer belt 48.

On exiting press nip 45, paper sheet 40 adheres to the surface of the transfer belt 48, whose surface is smoother than that of press fabric 43. Proceeding toward the right in the figure from press nip 45, paper sheet 40 and transfer belt 48 approach a second vacuum transfer roll 49. Press fabric 43 is directed by means of second guide roll 50, third guide roll 51 and fourth guide roll 52, back to first guide roll 42, where it may again receive paper sheet 40 from pick-up fabric 41.

At second vacuum transfer roll 49, paper sheet 40 is transferred to a dryer fabric 53, which is trained and directed thereabout. Dryer fabric 53 carries paper sheet 40 toward the first dryer cylinder 54 of the dryer section.

The transfer belt 48 proceeds onward to the right in the figure away from second vacuum transfer roll 49 to a fifth guide roll 55, around which it is directed to a sixth guide roll 56, a seventh guide roll 57, an eighth guide roll 58, and a ninth guide roll 59, which eventually return it to the first press roll 46 and to the press nip 45, where it may again accept the paper sheet 40 from the press fabric 43.

As may be observed in FIG. 3, the transfer belt 48 also eliminates open draws in the press arrangement shown, most particularly, the open draw between the press nip 45 and the second vacuum transfer roll 49. Paper sheet 40 is supported at all points in its passage through the press arrangement shown by a carrier. In addition, it should be noted that the paper sheet 40 is carried on the underside of the transfer belt 48 upon exiting from the press nip 45.

Figure 4:
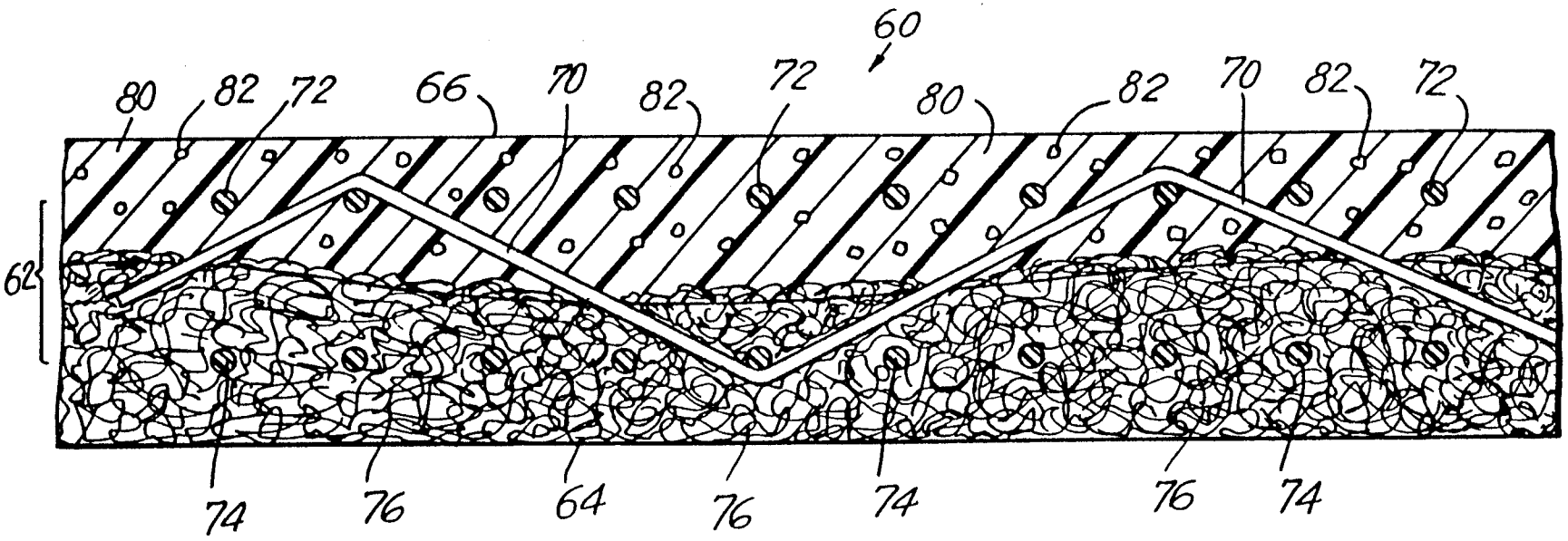
FIG. 4 shows a cross-sectional view, taken in the cross-machine direction, of the transfer belt of the present invention.

The transfer belt of the present invention may be used in any of the preceding press arrangements with results superior to those of the prior art, and may be seen in a cross section taken in the cross-machine direction in FIG. 4. The transfer belt 60 comprises a reinforcing base which is a woven base 62 having a back side 64 and a paper side 66.

The base 62 may be woven in a duplex pattern having vertically stacked weft yarns defining two layers bound together by a single system of warp yarns. In the base 62 shown in FIG. 4, warp yarns 70 lie in the cross-machine direction of the transfer belt 60. That is, the base 62 has been woven endless to produce the transfer belt 60 shown in the figure, although one may weave the base 62 in a manner permitting its being joined into endless form during the installation of the transfer belt 60 on a papermachine. In such case, the base 62 is flat woven, and its two ends provided with loops for closing into endless form with a pin seam. Alternatively, the two ends of a flat woven base 62 may be woven together forming a woven seam to place the base 62 into endless form. Again alternatively, base 62 may be woven by a modified endless weaving technique, wherein the filling yarns weave back and forth continuously between the opposite sides of the weaving loom and form the loops required for pin seaming at each side. In a base 62 woven by this last technique, the filling yarns run in the machine direction when the fabric is on a papermachine, and the loops are at each end as required. In each case, the base 62 may also be provided in a length substantially equal to the circumference of a press roll, so that a transfer belt 60 produced therewith may be used as a press roll cover through installation thereon in a sleeve-like fashion.

The machine-direction yarns of the base 62, seen in cross-section in FIG. 4, are the weft yarns during the weaving of an endless base. The top weft yarns 72 are on the paper side 66 of the transfer belt 60. In a vertically stacked one-to-one relationship with the top weft yarns 72 are the bottom weft yarns 74 on the back side 64 of the transfer belt 60. For purposes of clarity, the separations between the warp yarns 70, top weft yarns 72, and bottom weft yarns 74 have been greatly exaggerated in FIG. 4.

The yarns used to weave woven base 62, that is, the warp yarns 70, top weft yarns 72, and bottom weft yarns 74, may be monofilament yarns of a synthetic polymeric resin of one of the varieties commonly used in the weaving of fabrics for the papermaking industry, and are so depicted in FIG. 4. The yarns may be extruded from polyamide, polyimide, polyester, polyethylene terephthalate, polybutylene terephthalate, or from other synthetic polymeric resins. Monofilament yarns of the following diameters may be used in the weaving of base 62: 0.20 mm, 0.30 mm, 0.40 mm, or 0.50 mm. The base 62 should be woven in a pattern sufficiently open to ensure that the polymer coating applied to the paper side 66 may impregnate that side completely by surrounding the top weft yarns 72, so that, after curing, the polymer coating may form a mechanical interlock therewith.

Alternatively, the base 62 may be woven from multifilament yarns, plied monofilament yarns, or spun or textured yarns, produced from these resins. For example, the base 62 may include 3-, 4-, 6-, or 10-ply 8 mil (0.20 mm) plied monofilament yarns or 24-ply 0.10 mm multifilament yarns. In addition, the reinforcing base, instead of taking the form of woven base 62, may be a non-woven fiber assembly, a knitted fiber assembly, or a polymeric film. In the last case, the polymeric film may be permeable or impermeable, and may be reinforced by fibers.

The back side 64 of the base 62 may be needled with at least one layer of fibrous web 76. The needling process may be concluded with additional dry passes on both the back side 64 and the paper side 66 of the base 62. Fibrous web 76 may be needled directly into the back side 64 of the base 62, or may be needled into the paper side 66 thereof for a sufficiently long enough time to leave most of the needled fibers on the back side 64.

A textile material may be attached to the back side 64 of the woven base 62 instead of or in addition to fibrous web 76. Alternatively, a non-porous or porous polymeric film, or a polymeric foam, may be attached to the back side 64 of the woven base 62 in lieu of or in addition to fibrous web 76.

Coating 80 may be a non-organic particle-filled aqueous-based acrylic polymeric resin composition, mixed in batches of a suitable size, such as 150 kg, according to the following formulation:

| COMPONENT | WEIGHT % (WET) |
|---|---|
| Acrylic polymer resin (nonionic emulsion - 45% solids) | 59.8 |
| Water | 7.4 |
| Ammonium hydroxide | 1.0 |
| Kaolin clay | 26.8 |
| Surfactant (non-ionic acetylenic diol) | 0.9 |
| Polyether modified dimethyl polysiloxane copolymer solution (50% solids) (surface property enhancer) | 1.1 |
| Butyl cellosolve acetate | 0.7 |
| Dioctyl phthalate | 1.4 |
| Melamine formaldehyde resin | 0.8 |
| Amine salt of p-toluene sulfonic acid (25–28% solids) | 0.1 |

Ingredients were added into the polymeric resin composition in the order shown. Other additives may be used to improve processability, such as thickeners and defoamers. The kaolin clay may be omitted if a polymer coating not having a particulate filler is desired.

Alternatively, coating 80 may be a non-organic particle-filled aqueous-based polyurethane polymeric resin composition, mixed in batches of a suitable size, such as 150 kg, according to the following formulation:

| COMPONENT | WEIGHT % (WET) |
|---|---|
| Aliphatic polyurethane dispersion (35% solids) | 67.5 |

-continued

| COMPONENT | WEIGHT % (WET) |
|---|---|
| Ammonium hydroxide | 1.0 |
| Ethylene glycol | 1.9 |
| Kaolin clay | 23.6 |
| Surfactant (non-ionic acetylenic diol) | 0.8 |
| Polyether modified dimethyl polysiloxane copolymer solution (50% solids) (surface property enhancer) | 0.9 |
| Butyl cellosolve acetate | 0.6 |
| Dioctyl phthalate | 1.2 |
| Melamine formaldehyde resin | 2.3 |
| Amine salt of p-toluene sulfonic acid (25-28% solids) | 0.2 |

Again, ingredients may be added into the polymeric resin composition in the order shown. Other additives may be used to improve processability, such as thickeners and defoamers. Again, the kaolin clay may be omitted if a polymer coating not having a particulate filler is desired.

Coating 80 may also be of a non-organic particle-filled aqueous-based polyurethane/polycarbonate polymeric resin composition.

Kaolin clay is one particulate filler which may be included in coating 80, and is represented as particles 82 in FIG. 4. The distribution of particle sizes in kaolin clay (China clay) ranges from sub-micron size to over 53 microns. In general, however, at least 75% of the particles are smaller than 10 microns, and no more than 0.05% are larger than 53 microns.

In general, individual particles 82 in the particulate filler used will have a hardness different from that of the polymer coating 80. That is to say, the particles 82 may be either harder or softer than the polymer coating 80. Where the particulate filler is kaolin clay, the particles 82 will be harder than coating 80.

In broader terms, the particulate filler may include particles of a non-organic material, polymeric material, or metal. Kaolin clay is one possible non-organic material suitable for use as the particulate filler. A metal powder may also be used for this purpose; stainless steel is but one possible example. Where the particulate filler includes particles of metal, individual particles 82 will be harder than the coating 80. On the other hand, where the particulate filler includes particles of a polymeric material, individual particles 82, depending on their composition, may be either harder or softer than the coating 80.

The mixing of the components in each of the preceding formulations to produce the polymeric resin compositions for use as coating 80 may be carried out in an industrial mixer at a mixing speed of 550 rpm. At final dry weight, after drying and curing, the filler accounts for 45% of the weight of the coating 80, when it is included. This filler content provides the coating 80 with a harder and somewhat more hydrophilic surface, where the particulate filler is kaolin clay.

Coating 80 may be applied to the base 62 by means of a blade-coating procedure, wherein the base is extended between a pair of rollers in endless form, and moved thereabout at a speed of 1.5 m/min. The blade height above the taut base 62 is gradually raised to smooth the mixture being applied to achieve greater thickness.

Initially, with the blade height set at 0.0 mm, that is, barely contacting the surface of the base 62, the base 62 moves through two coating revolutions to allow effective penetration into the base structure. Subsequently, coating 80 is applied for anywhere from 2 to 5 revolutions, while the build up layers of gradually increasing thickness. Then, optionally, one or two additional coating revolutions may be made, increasing the blade height by as much as another 0.3 mm to provide a smooth finish. The coating 80 was then carefully dried for 2 or 3 final revolutions under infrared heaters providing a temperature in the nominal range from 30° C. to 40° C. The belt 60 may then be left under tension on the coating apparatus for several additional hours, perhaps as long as overnight, until dry.

The belt 60 should then be cured to ensure that the coating 80 adequately crosslinks to provide it with a positive mechanical interlock with the base 62. This positive mechanical interlock ensures that coating 80 will not delaminate during the use of the transfer belt 60 on a papermachine.

The belt 60 may be cured on a production dryer having a hot cylinder. For half of this time, the coated belt surface may face away from the hot cylinder surface, and this may be reversed for the second half of the curing time. The cylinder temperature may be 150° C. The belt speed on the cylinder may be 1.0 m/min.

The coating 80 may be ground on the same production dryer. Sandpaper of three different grades of coarseness, 50, 100 and 400, may be used to produce belts 60 with the required topography. The grinding procedure is begun with the most coarse sandpaper (50) in order to get even and totally ground surfaces. Grinding is continued with grade 100 sandpaper and finished with grade 400 sandpaper until the desired surface topography was obtained.

After grinding, the lateral edges of transfer belt 60 may be trimmed and melted before its removal from the production dryer.

The polymer coating 80 of the finished belt 60 has a hardness in the range from Shore A 50 to Shore A 97. Individual particles 82 in the particulate filler used will have hardnesses different from, that is, either harder or softer, that of polymer coating 80.

After grinding, the surface of the polymer coating 80 of the finished belt 60 has an uncompressed roughness in the range from 2 microns to 80 microns, measured as $R_z$-values according to ISO 4287, Part I. Specifically, $R_z$ is the ten-point height, defined in that International Standard Organization standard to be the average distance between the five highest peaks and the five deepest valleys within the sampling length measured from a line parallel to the mean line and not crossing the surface profile. When the belt 60 is in a press nip, where the linear load may typically be 100 kN/m, and more generally may fall within a range from 20 kN/m to 200 kN/m, the roughness is compressed to the range from 0 microns to 20 microns. Belt 60 has the capability of recovering its uncompressed roughness upon exit from a press nip, so that it may release a paper sheet in the intended manner. Whether compressed or uncompressed, the roughness is a measure of the amount by which the surface of the polymer coating 80 departs from absolute smoothness in a direction perpendicular thereto. Generally stated, the smoother the belt 60 becomes when compressed in the nip, the better belt 60 will work as a sheet-conveying belt, so long as it recovers its uncompressed roughness soon after exit from a press nip, as its success will be measured by its ability to permit a thin, continuous water film to be formed between its surface and that of a paper sheet in the press nip.

The back side 64 of base 62 may also be provided with a polymeric resin coating, which may be of the same composition as that provided on the paper side 66. Such a coating may be either porous or non-porous. A coating of the latter variety is required where the transfer belt of the invention is also to serve as a long nip press belt, which passes over the shoe or slot component in a long nip press. In such a case, the coating must be impermeable to prevent the oil used to lubricate the shoe, or the pressurized liquid in the slot, from contaminating the paper web. The coating must also be uniformly smooth and abrasion-resistant. A polyurethane resin composition may be used as a coating for the back side 64 where the transfer belt is also to be used as a long nip press belt.

As previously discussed, the mechanism by which the water film between a paper sheet and the transfer belt of the present invention is broken up after exit from a press nip is thought to be primarily a function of the pressure-responsive microscale surface topography of the surface of the coating on its paper side. With reference to FIGS. 5A through 5D, which depict on an exaggerated scale the roughness of the surface of the transfer belt of the present invention at the points labelled A, B, C, and D, respectively, in FIG. 3, this mechanism is shown schematically.

Figure 5A:
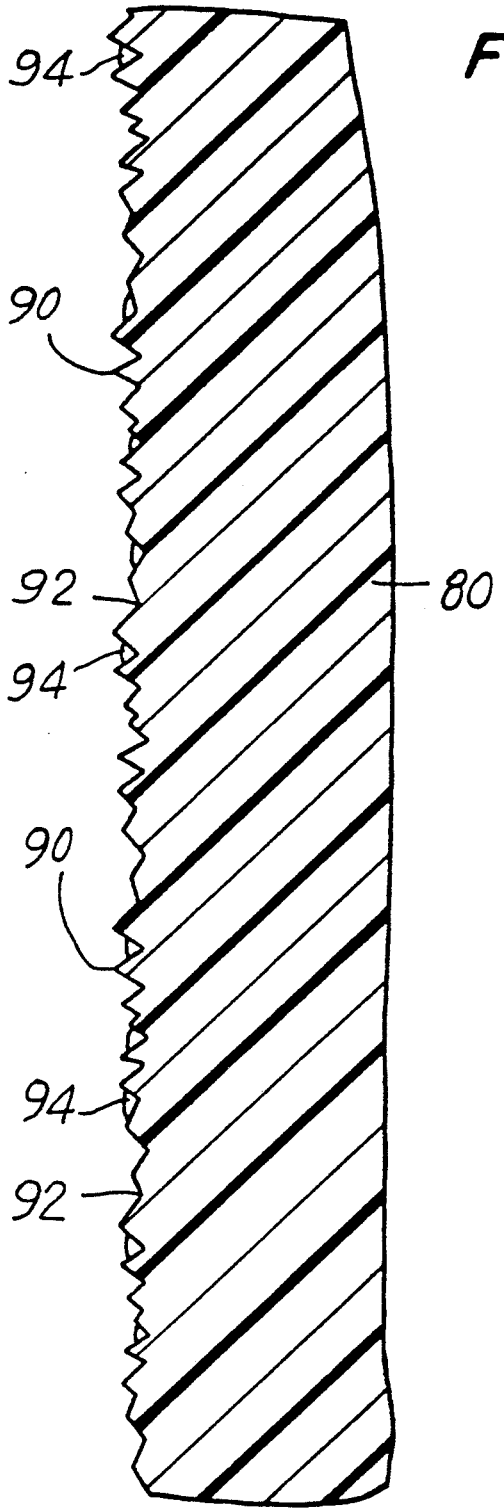
FIGS. 5A through 5D depict on an exaggerated scale, for the purpose of illustration, the roughness of the surface of the transfer belt of the present invention at the points labelled A, B, C, and D, respectively, in FIG. 3.

In FIG. 5A, a portion of the polymer coating 80 of the transfer belt as it might appear before entering a press nip, such as at point A in FIG. 3, is shown. The roughness, while greatly exaggerated for the purpose of illustration, is in the range from $R_z=2$ microns to 80 microns. The roughness is made apparent by the numerous peaks 90 and valleys 92 disposed along the surface. In some of the valleys 92, droplets 94 of water remain from the previous passage of the transfer belt through the press nip.

Figure 5B:
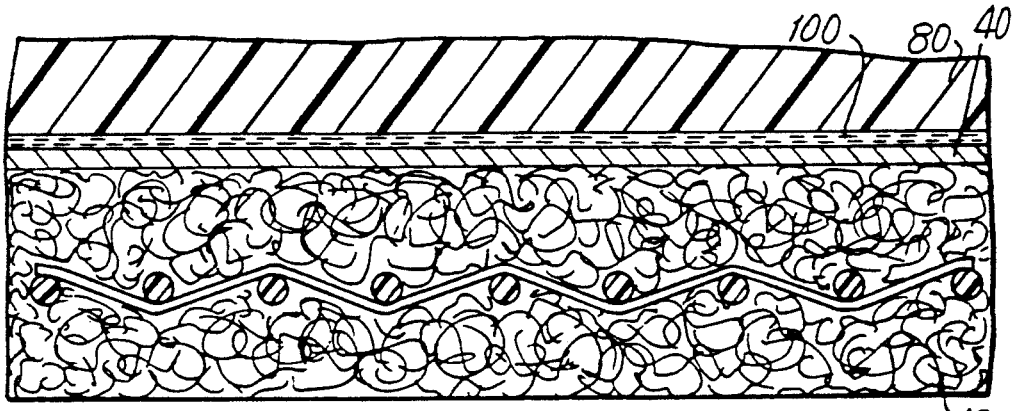

FIG. 5B shows a portion of the polymer coating 80 of the transfer belt as it might appear in a press nip, such as at point B in FIG. 3. A thin, continuous water film 100 resides between a paper sheet 40 and the polymer coating 80 of the transfer belt. The paper sheet 40 is supported by a press felt 43, which accepts some of the water pressed therefrom in the press nip. The surface of polymer coating 80 is depicted as being smooth; in actuality, it would have a roughness in the nip in the range from 0 microns to 20 microns.

Figure 5C:
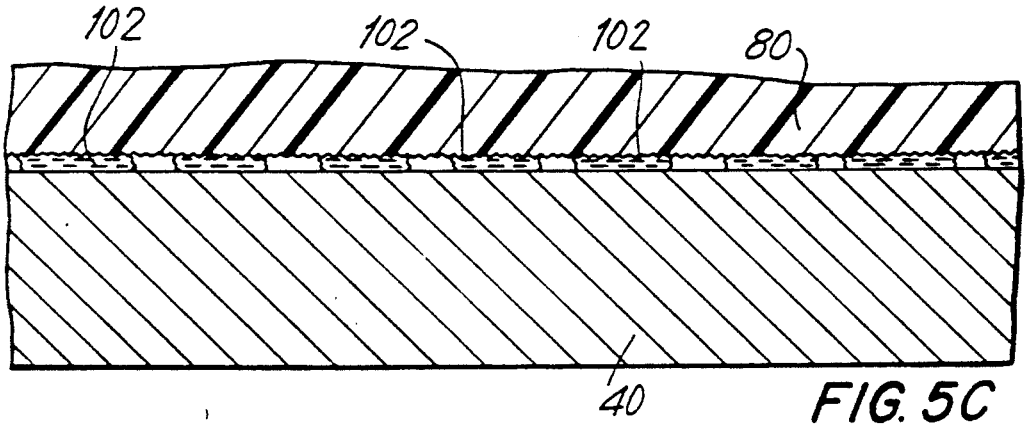

In FIG. 5C, which shows a portion of the polymer coating 80 of the transfer belt as it might appear at point C in FIG. 3, soon after exit from a press nip, but before reaching a transfer point, the surface of the polymer coating 0 has begun to recover its uncompressed roughness. The paper sheet 40 is still held to the underside of the transfer belt, but the thin, continuous water film 100 has begun to break up into droplets 102. As the roughness of the surface of the polymer coating 80 approaches its uncompressed value after exit from the nip, these droplets 102 will grow larger, increasing the separation between the paper sheet 40 and the polymer coating 80, and reducing the strength of the bond therebetween.

Figure 5D:
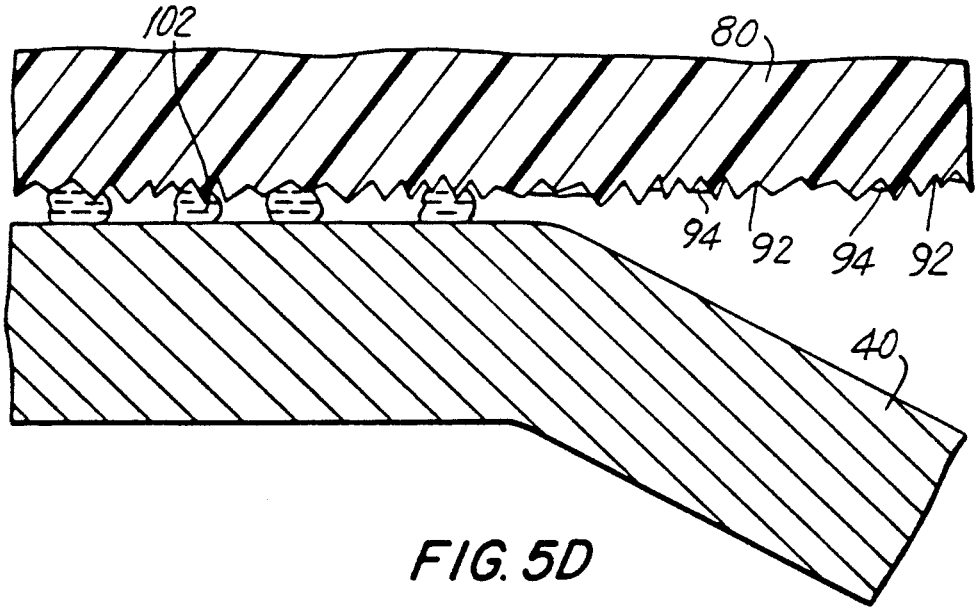

FIG. 5D shows a portion of polymer coating 80 as it might appear at point D in FIG. 3, where the paper sheet 40 is transferred to dryer fabric 53. By point D, the surface of the polymer coating 80 has fully recovered its uncompressed roughness, which, again, is in the range from $R_z=2$ microns to 80 microns. separated from one another, in turn increasing the separation between the paper sheet 40 and the surface of the polymer coating 80, and decreasing the strength of the bond by which paper sheet 40 is held thereto. After separation, when paper sheet 40 proceeds onto the dryer section, water droplets 94 remain in some of the valleys 92 of the rough surface of the polymer coating 80.

Figure 6:
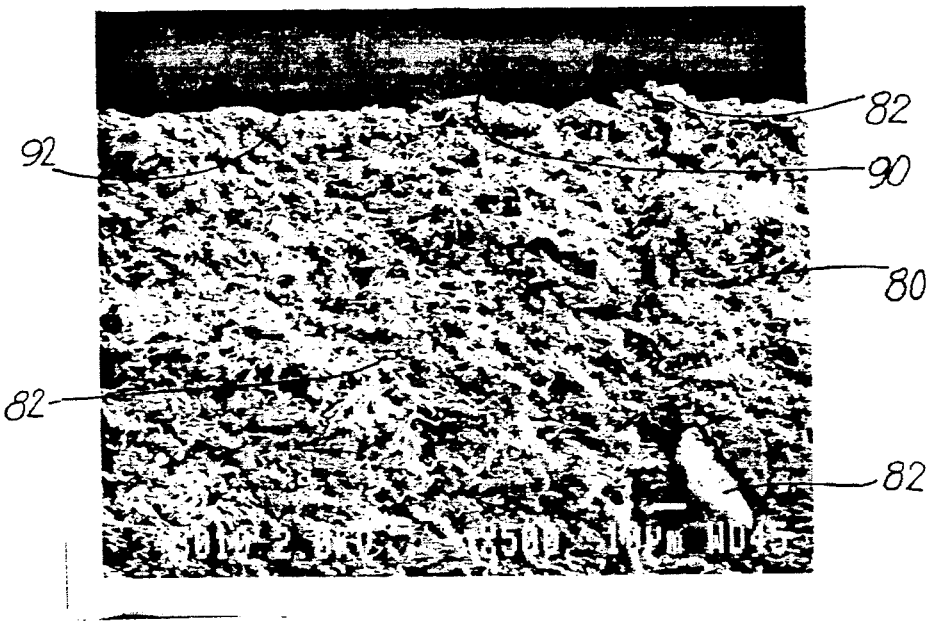
FIG. 6 is a Scanning Electron Microscope (SEM) photograph showing a cross section of the particle-filled polymer coating of the transfer belt of the present invention.

FIG. 6 is a Scanning Electron Microscope (SEM) photograph showing a cross section of the particle-filled polymer coating of the transfer belt of the present invention. Peaks 90 and valleys 92 are clearly visible on the surface of the polymer coating 80, as well as a number of individual particles 82 of the particulate filler. Some relatively large particles 82 protrude from the surface of the coating 80. One particle 82 does so approximately every fifteen polymer peaks 90. Distances in the photograph may be measured according to the scale appearing in the lower right-hand corner thereof.

Modifications to the above would be obvious to those skilled in the art, and would not bring the press fabric so modified beyond the scope of the appended claims.

What is claimed is:

1. In a papermaking or boardmaking machine, a transfer belt for carrying a paper web from a first transfer point, at which said transfer belt is subjected to compression in a press nip, in a closed draw to a second transfer point, said transfer belt comprising:

a reinforcing base, said reinforcing base having a back side and a paper side; and a polymer coating on said paper side of said reinforcing base, said polymer coating having a hardness in the range from Shore A 50 to Shore A 97, said polymer coating having a web-contacting surface with a pressure-responsive, recoverable degree of roughness throughout the lifetime of said transfer belt on said papermaking or boardmaking machine, said polymer coating having an uncompressed roughness in the range from $R_z=2$ microns to 80 microns, and being compressed to the range from $R_z=0$ microns to 20 microns when said transfer belt is in the press nip, and said polymer coating returning to its substantially uncompressed roughness after exit from the press nip, wherein said polymer coating includes a particulate filler, said particulate filler being a plurality of discrete particles incorporated within said polymer coating, and said discrete particles in said plurality thereof having a hardness different from that of said polymer coating, said transfer belt being substantially impermeable to air and water the permeability to air being less than 20 cubic feet per square foot per minute.

2. A transfer belt as claimed in claim 1 wherein said reinforcing base is a woven fabric, said woven fabric being woven from at least one system of machine-direction yarns and at least one system of cross-machine direction yarns, said machine direction and said cross-machine direction being the direction of motion and transverse to the direction of motion, respectively of said transfer belt on said papermaking or boardmaking machine.

3. A transfer belt as claimed in claim 2 wherein said woven fabric includes monofilament yarns.

4. A transfer belt as claimed in claim 1 wherein said reinforcing base is a non-woven fiber assembly.

5. A transfer belt as claimed in claim 1 wherein said reinforcing base is a knitted fiber assembly.

6. A transfer belt as claimed in claim 1 wherein said reinforcing base is a polymeric film.

7. A transfer belt as claimed in claim 6 wherein said polymeric film is permeable.

8. A transfer belt as claimed in claim 6 wherein said polymeric film is impermeable.

9. A transfer belt as claimed in claim 6 wherein said polymeric film is reinforced by fibers.

10. A transfer belt as claimed in claim 1 wherein said reinforcing base is in an endless-loop form.

11. A transfer belt as claimed in claim 1 wherein said reinforcing base is seamable into endless-loop form during installation of said transfer belt on said papermaking boardmaking machine.

12. A transfer belt as claimed in claim 1 wherein said reinforcing base has a length substantially equal to that of the circumference of a press roll, said machine being structured an arranged so that said transfer belt is used a sa press roll cover.

13. A transfer belt as claimed in claim 1 further comprising textile material, said textile material being attached to said back side of said reinforcing base.

14. A transfer belt as claimed in claim 1 further comprising a batt of staple fiber material, said batt being attached to said back side of said reinforcing base by needling.

15. A transfer belt as claimed in claim 1 further comprising a non-porous polymeric film, said film being attached to said back side of said reinforcing base.

16. A transfer belt as claimed in claim 1 further comprising a porous polymeric film, said film being attached to said back side of said reinforcing base.

17. A transfer belt as claimed in claim 1 further comprising a polymeric foam, said foam being attached to said back side of said reinforcing base.

18. A transfer belt as claimed in claim 1 wherein said particulate filler includes particles having a greater hardness than said polymer coating.

19. A transfer belt as claimed in claim 1 wherein said particulate filler includes particles having a lower hardness than said polymer coating.

20. A transfer belt as claimed in claim 1 wherein said particulate filler includes particles of a non-organic material.

21. A transfer belt as claimed in claim 20 wherein said non-organic material is kaolin clay.

22. A transfer belt as claimed in claim 1 wherein said particulate filler includes particles of a polymeric material.

23. A transfer belt as claimed in claim 1 wherein said particulate filler includes particles of a metal.

24. A transfer belt as claimed in claim 23 wherein said metal is stainless steel.

25. A transfer belt as claimed in claim 1 wherein said polymer coating includes a balanced distribution of hydrophilic and hydrophobic polymer segments, said balanced distribution forming a polymeric matrix having hydrophilic and hydrophobic regions.

26. A transfer belt as claimed in claim 25 wherein said polymer coating is an acrylic polymeric resin composition.

27. A transfer belt as claimed in claim 25 wherein said polymer coating is a polyurethane polymeric resin composition.

28. A transfer belt as claimed in claim 25 wherein said polymer coating is a polyurethane/polycarbonate polymeric resin composition.

29. A transfer belt as claimed in claim 25 wherein said polymer coating is a homopolymer.

30. A transfer belt as claimed in claim 25 wherein said polymer coating is a copolymer.

31. A transfer belt as claimed in claim 25 wherein said polymer coating is a polymer blend.

32. A transfer belt as claimed in claim 25 wherein said polymer coating is an interpenetrating network of polymers.

33. A transfer belt as claimed in claim 1 further comprising a polymeric resin coating on said back side of said reinforcing base.

34. A transfer belt as claimed in claim 33 wherein said polymeric resin coating on said back side of said reinforcing base is porous.

35. A transfer belt as claimed in claim 33 wherein said polymeric resin coating on said back side of said reinforcing base is non-porous.

36. A transfer belt as claimed in claim 33 wherein said polymeric resin coating on said back side of said reinforcing base is impermeable, uniformly smooth and abrasive-resistant, said machine being structured and arranged so that said transfer belt is also used as a long nip press belt.

37. A transfer belt as claimed in claim 36 wherein said polymeric resin coating on said back side of said reinforcing base is a polyurethane resin.

38. A transfer belt as claimed in claim 1 wherein said polymer coating is impermeable.

* * * * *